US009828011B2

(12) United States Patent
Mongaya et al.

(10) Patent No.: US 9,828,011 B2
(45) Date of Patent: Nov. 28, 2017

(54) COMMUNICATION SYSTEM FOR GUIDEWAY MOUNTED VEHICLE AND METHOD OF USING THE SAME

(71) Applicant: Thales Canada Inc, Toronto, Ontario (CA)

(72) Inventors: Kit Mongaya, Pickering (CA); Firth Whitwam, Toronto (CA)

(73) Assignee: Thales Canada Inc, Toronto, Ontario (CA)

( * ) Notice: Subject to any disclaimer, the term of this patent is extended or adjusted under 35 U.S.C. 154(b) by 78 days.

(21) Appl. No.: 14/132,509

(22) Filed: Dec. 18, 2013

(65) Prior Publication Data

US 2015/0166085 A1 Jun. 18, 2015

(51) Int. Cl.
*G05D 1/00* (2006.01)
*B61L 23/34* (2006.01)
(Continued)

(52) U.S. Cl.
CPC ..... *B61L 23/34* (2013.01); *B61L 15/0027* (2013.01); *B61L 25/025* (2013.01)

(58) Field of Classification Search
USPC ..... 701/19
See application file for complete search history.

(56) References Cited

U.S. PATENT DOCUMENTS 6,226,572 B1 5/2001 Tojima et al.
6,862,500 B2 3/2005 Tzamaloukas
(Continued)

FOREIGN PATENT DOCUMENTS

CN 102700571 10/2012
JP 2001188994 7/2001
(Continued)

OTHER PUBLICATIONS

Joel VanderWerf, et al., "Conceptual Development and Performance Assessment for the Deployment Staging of Advanced Vehicle Control and Safety Systems," Aug. 1, 2004, <http://escholarship.org/uc/item/8hg3b55r#page-1>.
(Continued)

*Primary Examiner* — Hussein A. Elchanti
(74) *Attorney, Agent, or Firm* — Hauptman Ham, LLP

(57) ABSTRACT

A communication system for a guideway mounted vehicle includes a control system communication system configured to exchange information between the guideway mounted vehicle and an external control system. The communication system further includes a vehicle-to-vehicle communication system configured to exchange information between the guideway mounted vehicle and another vehicle along the guideway, wherein the vehicle-to-vehicle communication system is separate from the control system communication system, and the vehicle-to-vehicle communication system is configured to exchange information directly between the guideway mounted vehicle and the other vehicle. The communication system further includes a vital on-board controller (VOBC) configured to generate instructions for controlling the exchange of information between the guideway mounted vehicle and the control system through the control system communication system, and to generate instructions for controlling the exchange information between the guideway mounted vehicle and the other vehicle.

21 Claims, 3 Drawing Sheets

(51) Int. Cl.
*B61L 15/00* (2006.01)
*B61L 25/02* (2006.01)

(56) References Cited

U.S. PATENT DOCUMENTS

| | | | | |
|---|---|---|---|---|
| 7,188,026 | B2 | 3/2007 | Tzamaloukas | |
| 7,188,341 | B1 | 3/2007 | Hawthorne et al. | |
| 7,206,676 | B2 | 4/2007 | Cross et al. | |
| 8,068,979 | B2 | 11/2011 | Breed | |
| 8,100,426 | B2 | 1/2012 | Kronenberg | |
| 8,185,264 | B2 | 5/2012 | Carroll | |
| 8,335,627 | B2 | 12/2012 | Cho | |
| 2006/0224301 | A1* | 10/2006 | Sakagami et al. | 701/200 |
| 2010/0082179 | A1 | 4/2010 | Kronenberg | |
| 2010/0094532 | A1* | 4/2010 | Vorona | 701/119 |
| 2010/0248618 | A1* | 9/2010 | Bai et al. | 455/11.1 |
| 2010/0260046 | A1* | 10/2010 | Reumerman et al. | 370/232 |
| 2010/0286864 | A1* | 11/2010 | Kawauchi | G01S 5/0072 701/31.4 |
| 2011/0172856 | A1 | 7/2011 | Kull | |
| 2012/0123660 | A1* | 5/2012 | Kagawa et al. | 701/96 |
| 2012/0158820 | A1* | 6/2012 | Bai et al. | 709/202 |
| 2012/0166059 | A1* | 6/2012 | Aso | 701/96 |
| 2013/0030688 | A1* | 1/2013 | Shimizu et al. | 701/301 |
| 2013/0086164 | A1* | 4/2013 | Wheeler et al. | 709/204 |
| 2013/0124012 | A1* | 5/2013 | Shida et al. | 701/2 |
| 2013/0201316 | A1* | 8/2013 | Binder | H04L 67/12 348/77 |
| 2014/0292545 | A1* | 10/2014 | Nemoto | 340/988 |
| 2014/0297063 | A1* | 10/2014 | Shida | 701/1 |
| 2014/0324329 | A1* | 10/2014 | Abuelsaad et al. | 701/301 |
| 2015/0100190 | A1* | 4/2015 | Yopp | B60T 7/18 701/23 |
| 2015/0163306 | A1* | 6/2015 | Nakagawa | B60R 25/2018 709/225 |

FOREIGN PATENT DOCUMENTS

| | | |
|---|---|---|
| JP | 2001195128 | 7/2001 |
| JP | 2003044139 | 2/2003 |
| WO | 0219566 | 3/2002 |

OTHER PUBLICATIONS

Andy Conrad, et al., "Chicago: Vision for the Future Responsive Transport," 2008, <http://trex.id.iit.edu/~pdesai/responsive_transport_report_full.pdf>.

International Search Report for corresponding International PCT Application No. PCT/IB2014/063444, dated Oct. 9, 2014.

* cited by examiner

COMMUNICATION SYSTEM FOR GUIDEWAY MOUNTED VEHICLE AND METHOD OF USING THE SAME

BACKGROUND

A guideway mounted vehicle receives information related to other vehicles along a same guideway through a control system. The control system provides information related to location and speed of the other vehicles and provides instructions for movement of the guideway mounted vehicle based on this location and speed information. The control system communicates this information through communication devices located along a wayside of the guideway.

The communication devices along the guideway act as relays between the control system and the guideway mounted vehicle. In order for information regarding the other vehicle to be received by the guideway mounted vehicle, the other vehicle first determines the information and then transmits the information to a wayside communication device. The wayside communication device transmits the information to the control system. The control system then transmits the information to another wayside device near the guideway mounted vehicle. The other wayside device then transmits the information to the guideway mounted vehicle. Such a system has at least five points of failure which could interrupt receipt of the information by the guideway mounted vehicle; each of the wayside communication devices, the control system, the other vehicle and the guideway mounted vehicle.

When one of the points of failure causes the information to be interrupted the guideway mounted vehicle would proceed to the end of a limit of movement authority (LMA) and stop to await further instructions or for a manual operator to arrive.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
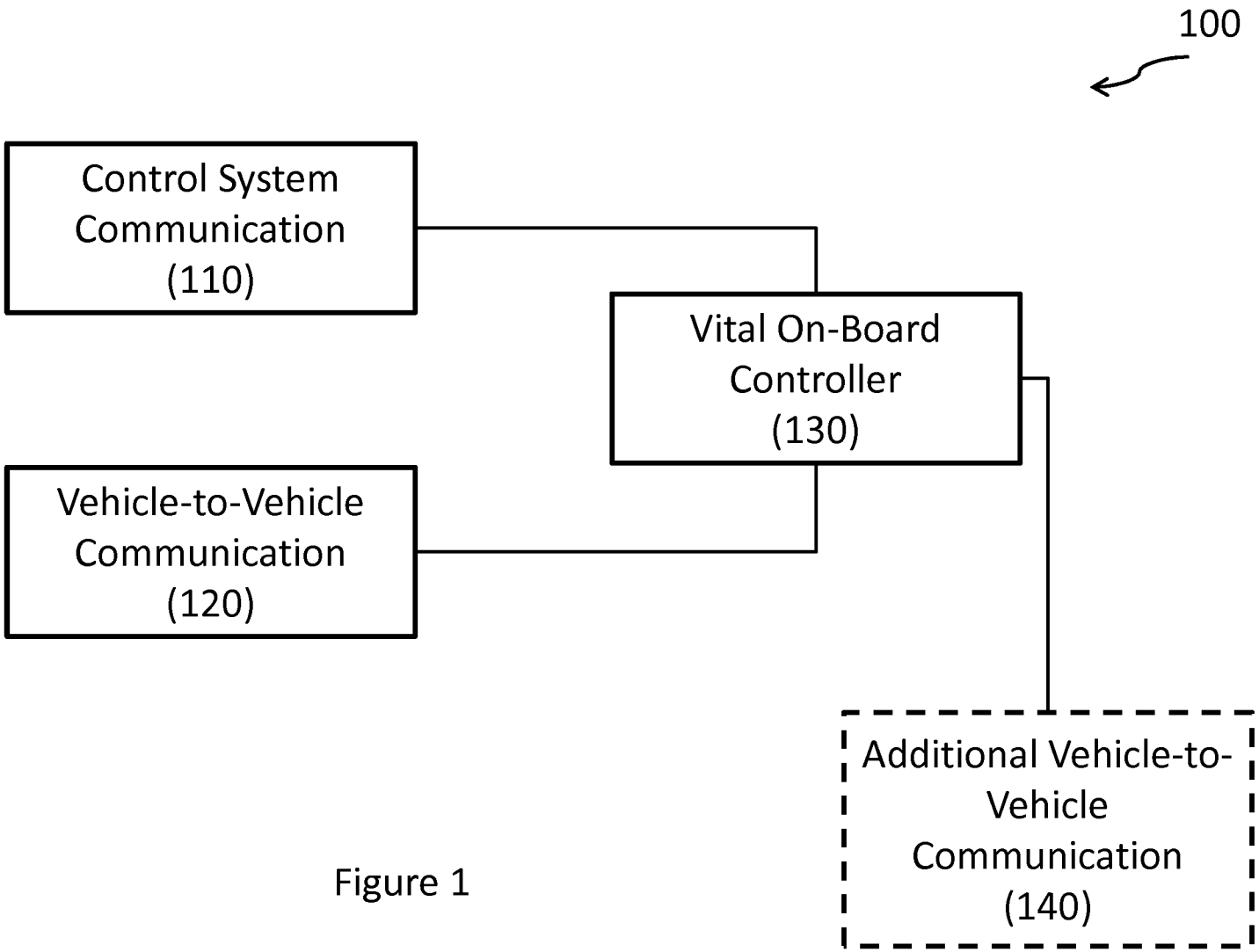
FIG. 1 is a block diagram of a communication system for a guideway mounted vehicle in accordance with one or more embodiments.

FIG. 1 is a block diagram of a communication system 100 for a guideway mounted vehicle in accordance with one or more embodiments. Communication system 100 includes a control system communication system 110 configured to exchange information related to the guideway mounted vehicle and a guideway database with a control system, such as a centralized or de-centralized control system. Communication system 100 further includes a vehicle-to-vehicle communication system 120 separate from control system communication system 110. Vehicle-to-vehicle communication system 120 is configured to exchange information directly between the guideway mounted vehicle and another vehicle along a same guideway without passing information through the control system. Communication system 100 further includes a vital on-board controller (VOBC) 130 connected to control system communication system 110 and vehicle-to-vehicle communication system 120. VOBC 130 is configured to receive information from each of control system communication system 110 and vehicle-to-vehicle communication system 120 and determine whether to establish communication with another vehicle, maintain communication with another vehicle or tear down communication with another vehicle. In some embodiments, VOBC 130 is configured to generate instructions for controlling an acceleration and braking system of the guideway mounted vehicle. In some embodiments, communication system 100 further includes an additional vehicle-to-vehicle communication system 140 configured to communicate with a second other vehicle along the guideway.

Control system communication system 110 is configured to exchange information between the guideway mounted vehicle and the control system. In some embodiments, control system communication system 110 includes an antenna, a transceiver, an amplifier, or other suitable communication equipment to facilitate communication between the guideway mounted vehicle and the control system. Control system communication system 110 is configured to receive information related to the guideway database.

The guideway database includes information about the guideway, such as location of platforms, position of switches (i.e., locked or disturbed), condition of the guideway, or other suitable guideway information. In some embodiments, the guideway includes a railroad track, a monorail track, an elevated track, a street car track, or another suitable guideway. The guideway database further includes information about other vehicles along the guideway such as location and speed of the other vehicles, identifying information of the other vehicle, or other suitable vehicle information. In some embodiments, the guideway database includes information related to a guideway network which includes multiple guideways.

Control system communication system 110 is configured to receive updates to the guideway database, which is stored in VOBC 130, based on information received by the control system from other vehicles on the guideway. Control system communication system 110 is also configured to transmit information regarding the guideway mounted vehicle to the control system. In some embodiments, control system communication system 110 receives information from the control system along a same communication path as information relating to the guideway mounted vehicle is transmitted. For example, in some embodiments, a same antenna is used to exchange information with a wayside communication device. In some embodiments, control system communication system 110 has different communication paths for sending and receiving information. For example, a first antenna is capable of receiving information and a second, separate, antenna is capable of transmitting information.

Vehicle-to-vehicle communication system 120 is configured to exchange information directly with another vehicle along the guideway without relaying the information through the control system. In some embodiments, vehicle-to-vehicle communication system 120 includes an antenna, a transceiver, an amplifier, or other suitable communication equipment to facilitate communication between the guideway mounted vehicle and the other vehicle. Vehicle-to-vehicle communication system 120 is configured to receive information related to the other vehicle such as location and speed.

Vehicle-to-vehicle communication system 120 is also configured to transmit information regarding the guideway mounted vehicle to the other vehicle. In some embodiments, vehicle-to-vehicle communication system 120 receives information from the other vehicle along a same communication path as information related to the guideway mounted vehicle is transmitted. For example, in some embodiments, a same antenna is used to exchange information with the other vehicle. In some embodiments, vehicle-to-vehicle communication system 120 has different communication paths for sending and receiving information. For example, a first antenna is capable of receiving information and a second, separate, antenna is capable of transmitting information.

In some embodiments, a structure of vehicle-to-vehicle communication system 120 is similar to a structure of control system communication system 110. In some embodiments, the structure of vehicle-to-vehicle communication system 120 is different from the structure of control system communication system 110. In some embodiments, a communication range of vehicle-to-vehicle communication system 120 is different from a communication range of control system communication system 110. In some embodiments, vehicle-to-vehicle communication system 120 is sensitive to the same electromagnetic spectrum as control system communication system 110. In some embodiments, both vehicle-to-vehicle communication system 120 and control system communication system 110 are sensitive to radio wave communication, microwave communication, infrared communication visible light communication or other suitable spectrums. In some embodiments, vehicle-to-vehicle communication system 120 is sensitive to a different electromagnetic spectrum from control system communication system 110. For example, vehicle-to-vehicle communication system 120 is sensitive to radio wave communication and control system communication 110 is sensitive to microwave communication.

In some embodiments, vehicle-to-vehicle communication system 120 is able to communicate with more than one other vehicle. For example, a vehicle in front of the guideway mounted vehicle and a vehicle behind the guideway mounted vehicle. In some embodiments, additional vehicle-to-vehicle communication system 140 is used to communicate with a second vehicle along the guideway. For example, vehicle-to-vehicle communication system 120 communicates with a vehicle in front of the guideway mounted vehicle and additional vehicle-to-vehicle communication system 140 communicates with a vehicle behind the guideway mounted vehicle. In some embodiments, more vehicle-to-vehicle communication systems are included in communication system 100 to facilitate communication with more vehicles along the guideway.

VOBC 130 is configured to receive information from both control system communication system 110 and vehicle-to-vehicle communication system 120. VOBC is also configured to determine location and speed information with respect to the guideway mounted vehicle and provide that information to control system communication system 110 and vehicle-to-vehicle communication 120 for transmission. VOBC 130 is also configured to determine whether to establish communication with another vehicle based on a distance between the guideway mounted vehicle and the other vehicle. VOBC 130 determines the distance between the guideway mounted vehicle and the other vehicle based on the guideway database information received from control system communication system 110. A threshold distance which causes VOBC 130 to establish communication with the other vehicle is called the communication initiation distance (CID). In some embodiments, the CID is determined based on a speed of the guideway mounted vehicle. In some embodiments, the CID is approximately equal to 1.5 to 3.0 times a stopping distance of the guideway mounted vehicle. In some embodiments, the CID is a predetermined value. In some embodiments, the CID is defined based on instructions from the control system. In some embodiments, the CID is defined based on whether communication with the control system is interrupted.

VOBC 130 is configured to receive the guideway database information from control system communication system 110 and determine whether another vehicle is within the CID in a direction of travel of the guideway mounted vehicle. In some embodiments, VOBC 130 only monitors in front of the guideway mounted vehicle in a direction of travel to determine if a vehicle is within the CID. In some embodiments, VOBC 130 monitors in both direction of the guideway mounted vehicle to determine if another vehicle is within the CID. If VOBC 130 determines that another vehicle is within the CID, the VOBC is configured to send a signal to vehicle-to-vehicle communication system 120 to establish communication with the other vehicle. In some embodiments, the guideway database information includes an identification of the other vehicle and VOBC 130 generates a signal based on a unique communication frequency associated with the identification of the other vehicle. If VOBC 130 determines that no other vehicle is within the CID, the VOBC does not attempt to establish communication with another vehicle.

Once communication with the other vehicle is established, VOBC 130 is configured to transmit information related to the guideway mounted vehicle including location, speed or identifying information to the other vehicle through vehicle-to-vehicle communication system 120. VOBC 130 is also configured to receive information related to the other vehicle such as location and speed through vehicle-to-vehicle communication system 120. The communication between the guideway mounted vehicle and the other vehicle is maintained until VOBC 130 sends a signal to tear down the communication.

In some embodiments, VOBC 130 is configured to tear down the communication if the distance between the guideway mounted vehicle and the other vehicle exceeds the CID. In some embodiments, VOBC 130 is configured to tear down the communication if the guideway mounted vehicle changes direction along the guideway, i.e., the other vehicle is no longer in front of the guideway mounted vehicle in the direction of travel. In some embodiments, VOBC 130 is configured to tear down the communication if the other vehicle traverses a switch which the guideway mounted vehicle does not have permission to traverse. In some embodiments, VOBC 130 is configured to tear down the communication if the other vehicle switches to another guideway, i.e., the other vehicle is no long on a same guideway as the guideway mounted vehicle.

In some embodiments, VOBC 130 is configured to generate instructions for the acceleration and braking system of the guideway mounted vehicle based on information received from the other vehicle through vehicle-to-vehicle communication system 120. For example, if VOBC 130 receives information that the other vehicle is reducing speed, the VOBC generates an instruction to reduce the speed of the guideway mounted vehicle to maintain a distance between the other vehicle and the guideway mounted vehicle at least equal to the stopping distance of the guideway mounted vehicle.

In some embodiments, VOBC 130 is implemented by running a background process on every vital machine having safety integrity level 4 (SIL 4) in the system which listens to communication traffic and collects key data as identified by a configuration profile of the VOBC. In some embodiments, SIL 4 is based on International Electrotechnical Commission's (IEC) standard IEC 61508, in at least one embodiment. SIL level 4 means the probability of failure per hour ranges from $10^{-8}$ to $10^{-9}$.

Figure 2:
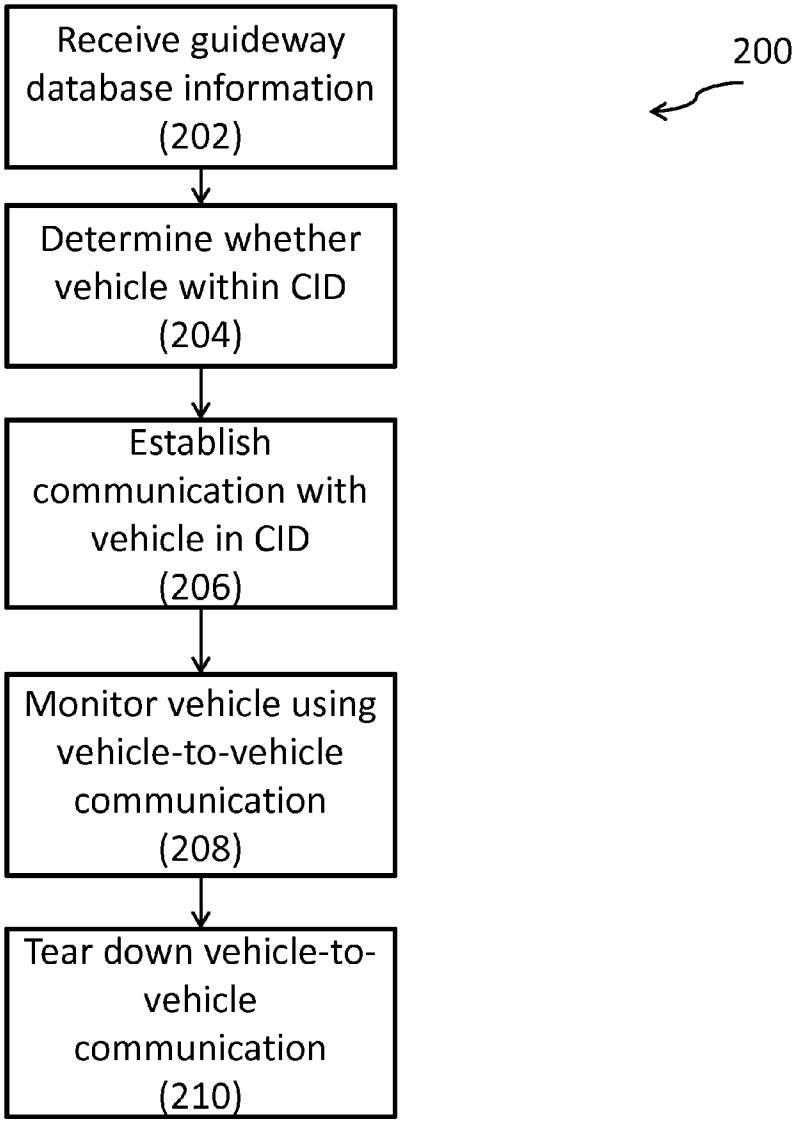
FIG. 2 is a flow chart of a method of using a vehicle-to-vehicle communication system in accordance with one or more embodiments.

FIG. 2 is a flow chart of a method 200 of using a vehicle-to-vehicle communication system in accordance with one or more embodiments. Method 200 begins with operation 202 in which guideway database information is received. The guideway database information is received from a control system. In some embodiments, the guideway database information is received through a control system communication system, e.g., control system communication system 110 (FIG. 1). In some embodiments, the guideway database information includes updated information for a guideway database stored in a VOBC located on the guideway mounted vehicle. The guideway database information includes location information for other vehicles along the guideway. In some embodiments, the guideway database information includes identifying information for the other vehicles. In some embodiments, the identifying information includes a unique communication frequency for the other vehicle. The guideway database information is stored in the VOBC.

In operation 204, the VOBC determines whether another vehicle is within a CID of the guideway mounted vehicle. The VOBC uses the guideway database information from operation 202 to determine whether the other vehicle is within the CID of the guideway mounted vehicle. In some embodiments, the CID is equal to about 1.5 to about 3.0 times a stopping distance of the guideway mounted vehicle. In some embodiments, the CID is a predetermined value. In some embodiments, the CID is defined based on instructions from the control system. In some embodiments, the CID is defined based on whether communication with the control system is interrupted.

Communication with the other vehicle is established if the other vehicle is within the CID for the guideway mounted vehicle, in operation 206. Communication with the other vehicle is established using a vehicle-to-vehicle communication system, e.g., vehicle-to-vehicle communication system 120 (FIG. 1). The vehicle-to-vehicle communication system is separate from the control system communication system. Through the vehicle-to-vehicle communication system, the guideway mounted vehicle is able to communicate with the other vehicle without transmitting information to the control system.

In some embodiments, a communication range of the vehicle-to-vehicle communication system is different from a communication range of the control system communication system. In some embodiments, the vehicle-to-vehicle communication system is sensitive to a same electromagnetic spectrum as the control system communication system. In some embodiments, both the vehicle-to-vehicle communication system and the control system communication system are sensitive to radio wave communication, microwave communication, infrared communication visible light communication or other suitable spectrums. In some embodiments, the vehicle-to-vehicle communication system is sensitive to a different electromagnetic spectrum from the control system communication system.

In operation 208, the guideway mounted vehicle monitors the other vehicle on the guideway using the vehicle-to-vehicle communication system. In some embodiments, the guideway mounted vehicle monitors the other vehicle by collecting location and speed information through the vehicle-to-vehicle communication system. In some embodiments, the VOBC generates signals to control an acceleration and braking system of the guideway mounted database to maintain a distance between the other vehicle and the guideway mounted vehicle greater than or equal to the stopping distance of the guideway mounted vehicle. In some embodiments, the guideway mounted vehicle continues to monitor the other vehicle until the other vehicle is more than the CID away from the guideway mounted vehicle.

Communication along the vehicle-to-vehicle communication system is torn down in operation 210. The VOBC tears down communication between the other vehicle and the guideway mounted vehicle by sending instructions to the vehicle-to-vehicle communication system to cease communication with the other vehicle.

In some embodiments, the VOBC tears down the communication if the distance between the guideway mounted vehicle and the other vehicle exceeds the CID. In some embodiments, the VOBC tears down the communication if the guideway mounted vehicle changes direction along the guideway, i.e., the other vehicle is no longer in front of the guideway mounted vehicle in the direction of travel. In some embodiments, the VOBC tears down the communication if the other vehicle traverses a switch which the guideway mounted vehicle does not have permission to traverse. In some embodiments, the VOBC tears down the communication if the other vehicle switches to another guideway, i.e., the other vehicle is no long on a same guideway as the guideway mounted vehicle.

One of ordinary skill in the art would recognize that additional operations are able to be added or operations are able to be omitted from method 200 without departing from the scope of this description. One of ordinary skill in the art would also recognize that an order of operations is adjustable within method 200.

Figure 3:
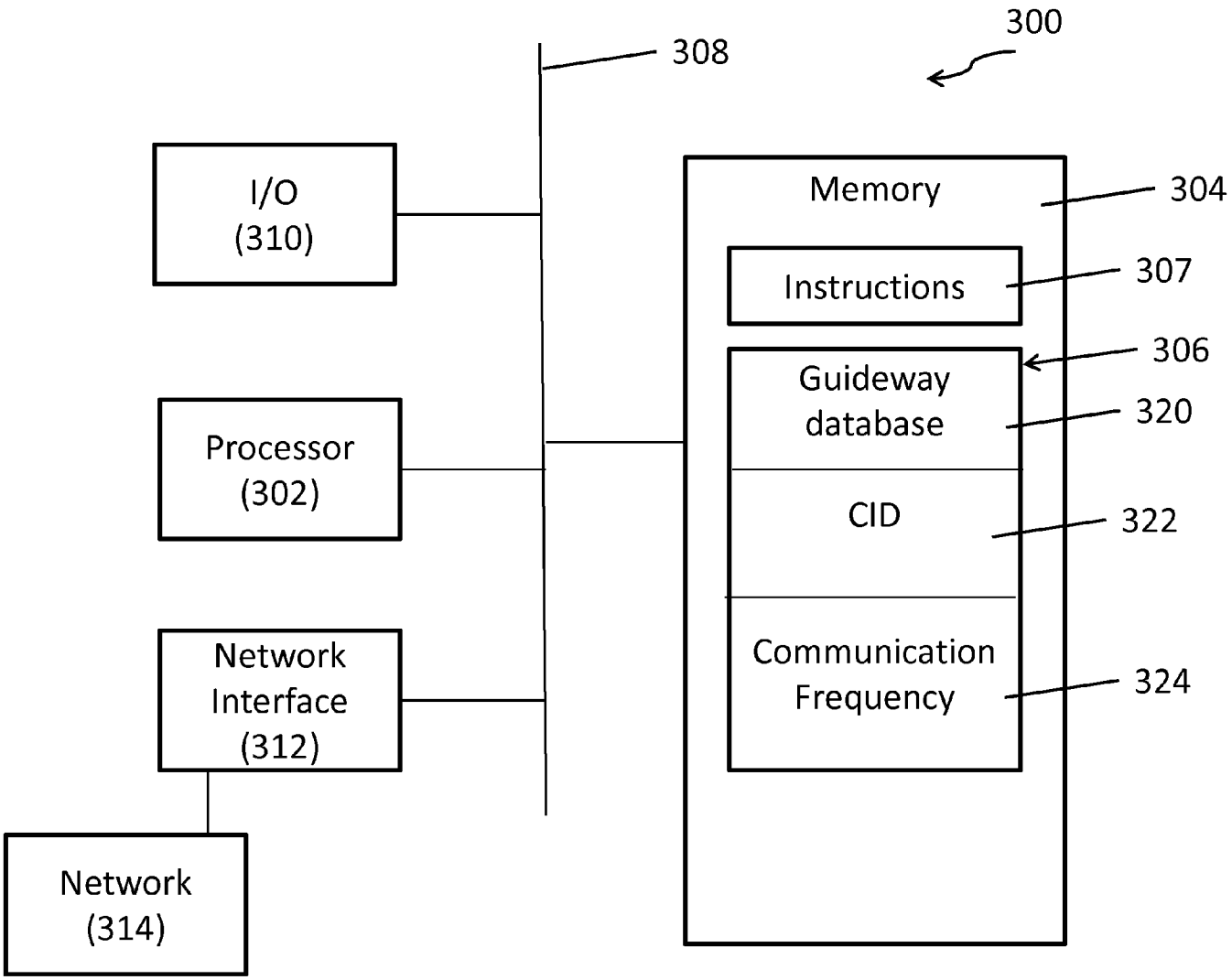
FIG. 3 is a block diagram of a general purpose computing device for operating a vehicle-to-vehicle communication system in accordance with one or more embodiments.

FIG. 3 is a schematic view of a system 300 for altering a design for a memory array or executing a production process for either a floating gate memory array or a charge trapping memory array in accordance with one or more embodiments. System 300 includes a hardware processor 302 and a non-transitory, computer readable storage medium 304 encoded with, i.e., storing, the computer program code 306, i.e., a set of executable instructions. Computer readable storage medium 304 is also encoded with instructions 307 for interfacing with a control system communication system and a vehicle-to-vehicle communication system. The processor 302 is electrically coupled to the computer readable storage medium 304 via a bus 308. The processor 302 is also electrically coupled to an I/O interface 310 by bus 308. A network interface 312 is also electrically connected to the processor 302 via bus 308. Network interface 312 is connected to a network 314, so that processor 302 and computer readable storage medium 304 are capable of connecting to external elements via network 314 such as the control system communication system or the vehicle-to-vehicle communication system. The processor 302 is configured to execute the computer program code 306 encoded in the computer readable storage medium 304 in order to cause system 300 to be usable for performing a portion or all of the operations as described in method 200.

In some embodiments, the processor 302 is a central processing unit (CPU), a multi-processor, a distributed processing system, an application specific integrated circuit (ASIC), and/or a suitable processing unit.

In some embodiments, the computer readable storage medium 304 is an electronic, magnetic, optical, electromagnetic, infrared, and/or a semiconductor system (or apparatus or device). For example, the computer readable storage medium 304 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 304 includes a compact disk-read only memory (CD-ROM), a compact disk-read/write (CD-R/W), and/or a digital video disc (DVD).

In some embodiments, the storage medium 304 stores the computer program code 306 configured to cause system 300 to perform method 200. In some embodiments, the storage medium 304 also stores information needed for performing a method 200 as well as information generated during performing the method 200, such as a guideway database parameter 320, a CID parameter 322, a communication frequency parameter 324, and/or a set of executable instructions to perform the operation of method 200.

In some embodiments, the storage medium 304 stores instructions 307 for interfacing with manufacturing machines. The instructions 307 enable processor 302 to generate communication instructions readable by the vehicle-to-vehicle communication system to effectively implement method 200 during operation.

System 300 includes I/O interface 310. I/O interface 310 is coupled to external circuitry. In some embodiments, I/O interface 310 includes a keyboard, keypad, mouse, trackball, trackpad, and/or cursor direction keys for communicating information and commands to processor 302.

System 300 also includes network interface 312 coupled to the processor 302. Network interface 312 allows system 300 to communicate with network 314, to which one or more other computer systems are connected. Network interface 312 includes wireless network interfaces such as BLUETOOTH, WIFI, WIMAX, GPRS, or WCDMA; or wired network interface such as ETHERNET, USB, or IEEE-1394. In some embodiments, method 200 is implemented in two or more systems 200, and information such as guideway database information, the CID or the communication frequency are exchanged between different systems 300 via network 314.

System 300 is configured to receive information related to a guideway database through network interface 312. The information is transferred to processor 302 via bus 308 to determine the guideway database information. The guideway database information is then stored in computer readable medium 304 as guideway database parameter 320. In some embodiments, system 300 is configured to receive information related to the CID through I/O interface 310. In some embodiments, system 300 is configured to receive information related to the CID through network interface 312. The information is stored in computer readable medium 304 as CID parameter 322. In some embodiments, system 300 is configured to receive information related to the communication frequency through I/O interface 310. In some embodiments, system 300 is configured to receive information related to the communication frequency through network interface 312. The information is stored in computer readable medium 304 as communication frequency parameter 324.

During operation, system 300 is configured to establish communication between a guideway mounted vehicle and another vehicle along the guideway through the vehicle-to-vehicle communication system. System 300 is also configured to monitor the other vehicle. In some embodiments, system 300 is further configured generate instructions for an acceleration and braking system to control a speed of the guideway mounted vehicle based on information received from the other vehicle through the vehicle-to-vehicle communication system. System 300 is further configured to tear down the vehicle-to-vehicle communication between the guideway mounted vehicle and the other vehicle.

One aspect of this description relates to a communication system for a guideway mounted vehicle. The communication system includes a control system communication system configured to exchange information between the guideway mounted vehicle and an external control system. The communication system further includes a vehicle-to-vehicle communication system configured to exchange information between the guideway mounted vehicle and another vehicle along the guideway, wherein the vehicle-to-vehicle communication system is separate from the control system communication system, and the vehicle-to-vehicle communication system is configured to exchange information directly between the guideway mounted vehicle and the other vehicle. The communication system further includes a vital on-board controller (VOBC) configured to generate instructions for controlling the exchange of information between the guideway mounted vehicle and the control system through the control system communication system, and to generate instructions for controlling the exchange information between the guideway mounted vehicle and the other vehicle.

Another aspect of this description relates to a method of using a communication system for a guideway mounted vehicle. The method includes determining whether another vehicle is within a communication initiation distance (CID) of the guideway mounted vehicle. The method further includes establishing communication with the other vehicle if the other vehicle is within the CID of the guideway mounted vehicle. The method further includes monitoring the other vehicle using a vehicle-to-vehicle communication system, wherein the vehicle-to-vehicle communication system is configured for direct communication between the guideway mounted vehicle and the other vehicle.

Still another aspect of this description relates to a control system for a guideway mounted vehicle. The control system includes a processor and a non-transitory computer readable medium connected to the processor. The non-transitory compute readable medium configured to store instructions for determining whether another vehicle is within a communication initiation distance (CID) of the guideway mounted vehicle. The non-transitory computer readable medium further configured to execute instructions for establishing communication with the other vehicle if the other vehicle is within the CID of the guideway mounted vehicle. The non-transitory computer readable medium further configured to execute instructions for monitoring the other vehicle using a vehicle-to-vehicle communication system, wherein the vehicle-to-vehicle communication system is configured for direct communication between the guideway mounted vehicle and the other vehicle.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A communication system for a guideway mounted vehicle, the communication system comprises:

a control system communication system configured to exchange information between the guideway mounted vehicle and an external control system, wherein the information is used to generate instructions to the guideway mounted vehicle;

a vehicle-to-vehicle communication system configured to exchange information between the guideway mounted vehicle and another vehicle along the guideway, wherein the vehicle-to-vehicle communication system is separate from the control system communication system, and the vehicle-to-vehicle communication system is configured to exchange information directly between the guideway mounted vehicle and the other vehicle; and a vital on-board controller (VOBC) configured to generate instructions to automatically establish communication between the guideway mounted vehicle and the other vehicle through the vehicle-to-vehicle communication system if a distance between the guideway mounted vehicle and the other vehicle is within a communication initiation distance (CID), for controlling the exchange of information between the guideway mounted vehicle and the external control system through the control system communication system, and to generate instructions for controlling the exchange of information between the guideway mounted vehicle and the other vehicle, and wherein the CID is at least equal to a stopping distance of the guideway mounted vehicle.

2. The communication system of claim 1, wherein the VOBC is further configured to determine a distance between the guideway mounted device and the other vehicle based on guideway database information received from the control system communication system.

3. The communication system of claim 1, wherein the VOBC is configured to generate instructions to establish communication between the guideway mounted vehicle and the other vehicle through the vehicle-to-vehicle communication system if a distance between the guideway mounted vehicle and the other vehicle is within a communication initiation distance (CID) or if a switch ahead of the guideway mounted vehicle provides a permission to travel in a same direction towards the other vehicle.

4. The communication system of claim 3, wherein the CID is equal to about 1.5 to about 3.0 times a stopping distance of the guideway mounted vehicle.

5. The communication system of claim 1, wherein the VOBC is configured to tear down communication between the guideway mounted vehicle and the other vehicle through the vehicle-to-vehicle communication system if a di stance between the guideway mounted vehicle and the other vehicle exceeds a CID.

6. The communication system of claim 1, wherein the VOBC is configured to tear down communication between the guideway mounted vehicle and the other vehicle through the vehicle-to-vehicle communication system if a direction of travel of the guideway mounted vehicle changes.

7. The communication system of claim 1, wherein the VOBC is configured to tear down communication between the guideway mounted vehicle and the other vehicle through the vehicle-to-vehicle communication system if the other vehicle traverses a switch which the guideway mounted vehicle lacks permission to traverse.

8. The communication system of claim 1, wherein the VOBC is configured to tear down communication between the guideway mounted vehicle and the other vehicle through the vehicle-to-vehicle communication system if the other vehicle switches to a different guideway.

9. The communication system of claim 1, further comprising an additional vehicle-to-vehicle communication system connected to the VOBC, the additional vehicle-to-vehicle communication system configured to exchange information with a second vehicle different from the other vehicle.

10. A method of using a communication system for a guideway mounted vehicle, the method comprising:

determining whether another vehicle is within a communication initiation distance (CID) of the guideway mounted vehicle, wherein the CID is at least equal to a stopping distance of the guideway mounted vehicle;

establishing communication with the other vehicle if the other vehicle is within the CID of the guideway mounted vehicle, wherein the communication is established by a vital on-board controller (VOBC) automatically when the other vehicle is within the CID; and monitoring the other vehicle using a vehicle-to-vehicle communication system, wherein the vehicle-to-vehicle communication system is configured for direct communication between the guideway mounted vehicle and the other vehicle.

11. The method of claim 10, further comprising receiving guideway database information through a control system communication system separate from the vehicle-to-vehicle communication system.

12. The method of claim 11, wherein determining whether the other vehicle is within the CID of the guideway mounted vehicle comprises comparing a location of the other vehicle to a location of the guideway mounted vehicle using the guideway database information.

13. The method of claim 10, further comprising tearing down communication between the guideway mounted vehicle and the other vehicle through the vehicle-to-vehicle communication system if a distance between the guideway mounted vehicle and the other vehicle exceeds the CID.

14. The method of claim 10, further comprising tearing down communication between the guideway mounted vehicle and the other vehicle through the vehicle-to-vehicle communication system if a direction of travel of the guideway mounted vehicle changes.

15. The method of claim 10, further comprising tearing down communication between the guideway mounted vehicle and the other vehicle through the vehicle-to-vehicle communication system if the other vehicle traverses a switch which the guideway mounted vehicle lacks permission to traverse.

16. The method of claim 10, further comprising tearing down communication between the guideway mounted vehicle and the other vehicle through the vehicle-to-vehicle communication system if the other vehicle switches to a different guideway from the guideway mounted vehicle.

17. The method of claim 10, further comprising adjusting a speed of the guideway mounted vehicle based on information received from the other vehicle through the vehicle-to-vehicle communication system.

18. A control system for a guideway mounted vehicle, the control system comprising:

a processor; and a non-transitory computer readable medium connected to the processor, the non-transitory compute readable medium configured to store instructions for executing the following operations:

determining whether another vehicle is within a communication initiation distance (CID) of the guideway mounted vehicle, wherein the CID is at least equal to a stopping distance of the guideway mounted vehicle;

establishing communication with the other vehicle if the other vehicle is within the CID of the guideway mounted vehicle, wherein the communication is established by a vital on-board controller (VOBC) automatically when the other vehicle is within the CID; and monitoring the other vehicle using a vehicle-to-vehicle communication system, wherein the vehicle-to-vehicle communication system is configured for direct communication between the guideway mounted vehicle and the other vehicle.

19. The control system of claim 18, wherein the non-transitory computer readable medium is further configured to store instructions for receiving guideway database information through a control system communication system separate from the vehicle-to-vehicle communication system.

20. The control system of claim 18, wherein the non-transitory computer readable medium is further configured to store instructions for tearing down communication between the guideway mounted vehicle and the other vehicle through the vehicle-to-vehicle communication system if a distance between the guideway mounted vehicle and the other vehicle exceeds the CID.

21. The communication system of claim 1, wherein the VOBC is configured to generate instructions to establish communication between the guideway mounted vehicle and the other vehicle through the vehicle-to-vehicle communication system if a switch ahead of the guideway mounted vehicle provides a permission to travel in a same direction towards the other vehicle.

* * * * *